US008734307B2

(12) United States Patent
Bathey

(10) Patent No.: US 8,734,307 B2
(45) Date of Patent: May 27, 2014

(54) CORE EXERCISE DEVICE

(76) Inventor: Chad Bathey, Wauwatosa, WI (US)

( * ) Notice: Subject to any disclaimer, the term of this patent is extended or adjusted under 35 U.S.C. 154(b) by 544 days.

(21) Appl. No.: 12/947,597

(22) Filed: Nov. 16, 2010

(65) Prior Publication Data

US 2012/0122637 A1 May 17, 2012

(51) Int. Cl.
*A63B 26/00* (2006.01)

(52) U.S. Cl.
USPC ..... 482/142; 482/148

(58) Field of Classification Search
USPC ..... 482/140–148, 114–115, 118–119
See application file for complete search history.

(56) References Cited

U.S. PATENT DOCUMENTS

| | | | | | |
|---|---|---|---|---|---|
| 2,013,520 | A * | 9/1935 | McDermott | 482/56 |
| 4,231,569 | A * | 11/1980 | Rae | 482/108 |
| 4,442,832 | A * | 4/1984 | Ollenberger | 606/244 |
| 4,535,762 | A * | 8/1985 | Natchev | 606/244 |
| 4,674,740 | A * | 6/1987 | Iams et al. | 482/56 |
| 5,178,593 | A * | 1/1993 | Roberts | 482/62 |
| 5,269,736 | A * | 12/1993 | Roberts | 482/62 |
| 5,456,644 | A * | 10/1995 | Hecox et al. | 482/127 |
| 5,810,702 | A * | 9/1998 | Wilkinson | 482/142 |
| 5,860,899 | A * | 1/1999 | Rassman | 482/142 |
| 5,997,450 | A * | 12/1999 | Wilkinson | 482/142 |
| 6,142,912 | A * | 11/2000 | Profaci | 482/8 |
| 6,196,954 | B1 * | 3/2001 | Chen | 482/131 |
| 6,352,493 | B1 * | 3/2002 | Davis | 482/56 |
| 6,790,164 | B1 * | 9/2004 | Davis | 482/56 |
| 7,147,593 | B2 * | 12/2006 | Vittone | 482/142 |
| 7,291,049 | B1 * | 11/2007 | Davis et al. | 441/55 |
| 7,601,103 | B2 * | 10/2009 | Chen et al. | 482/56 |
| 7,651,452 | B2 * | 1/2010 | Weir et al. | 482/142 |
| 7,691,042 | B2 * | 4/2010 | Pandozy | 482/142 |
| 8,012,073 | B2 * | 9/2011 | Barnett | 482/142 |
| 8,066,622 | B2 * | 11/2011 | Kim | 482/94 |
| 8,292,837 | B2 * | 10/2012 | Du | 601/24 |
| 2002/0147087 | A1 * | 10/2002 | Tollner | 482/147 |
| 2004/0198572 | A1 * | 10/2004 | Rouillard | 482/142 |
| 2005/0079957 | A1 * | 4/2005 | Bowman et al. | 482/51 |
| 2006/0073945 | A1 * | 4/2006 | Zuckerman | 482/56 |
| 2011/0039668 | A1 * | 2/2011 | McCall, Jr. | 482/142 |
| 2011/0224059 | A1 * | 9/2011 | Crawley | 482/142 |
| 2012/0015787 | A2 * | 1/2012 | Crawley et al. | 482/142 |

* cited by examiner

*Primary Examiner* — Stephen Crow
(74) *Attorney, Agent, or Firm* — Boyle Fredrickson, S.C.

(57) ABSTRACT

The present invention is core exercise device that allows lateral movement during a core exercise such as a sit-up, leg lift, or crunch in order to activate, exercise, and strengthen core muscles.

17 Claims, 6 Drawing Sheets

CORE EXERCISE DEVICE

BACKGROUND OF THE INVENTION

1. Field of the Invention

The present invention pertains to an exercise device for a human user; more particularly, to an exercise device that activates, strengthens, and conditions core and other muscles while the user performs sit-ups and other core exercises.

2. Discussion of the Related Art

Exercise equipment comprises many different devices for exercising the core muscles, including the back and abdominal muscles of the human body. The exercises may be used as physical therapy to strengthen muscles in an area that has been injured or suffers from some other pathological condition. In fact, exercises that invoke the transversus abdominus muscles (corset muscles) and other core muscles are used to treat and manage 1) spondylosis (degenerative osteoarthritis of the joints between the spinal vertebrae) and spondylolithesis (displacement of the vertebrae or vertebral column, sometimes called curvature of the back); 2) chronic or acute lower back dysfunction (LBD); 3) spina bifida; 4) hamstring strains; and 5) problems with the adductor magnus. In addition to physical therapy for rehabilitation, core exercises may be used to strengthen the muscles thereby improving the user's athletic performance or the user's appearance by reducing sagging and otherwise tightening and improving the tone of the core muscles.

Prior art core exercise devices, such as a slant board or roman chair, usually adopt "sit-up," "crunch," or "leg-lift," like body movements or combinations of two or more of these body movements. The goal of such exercise equipment is to strengthen core muscles including the abdomen and back muscles. Specific names of such muscles include, but are not limited to, the rectus abdominis, the external and internal abdominal obliques, adductor magnus, transversus abdominis, multifidus, and erector spinae.

In addition, exercise devices have been created which require a user to maintain balance and equilibrium. The goal of exercising with these types of equipment is to improve a user's core muscles or "stability muscles," thereby also improving the user's balance. Such muscles are located in a person's lower-torso region. Examples of equipment that facilitate balance are inflatable exercise balls such as the Swiss ball and the BOSU® ball, cylindrical rollers such as Air Roller™, and balancing pads such as DuraDisk™.

However, what is needed is a core exercise device that facilitates exercises dedicated to strengthening the aforementioned core muscles while improving balance. The present invention combines exercises for strengthening the core muscles with a balancing exercise without having to perform separate exercises on separate exercise devices.

SUMMARY OF THE INVENTION

The present invention relates to a core exercise device that allows the user to perform core exercises such as sit-ups while producing additional lateral movement to improve the training or rehabilitation of core muscles, as the user must counteract these additional lateral movements during the exercise.

Specifically, the present invention relates to a core exercise device that has a freestanding frame, a support to receive a human during exercises having a first end and a second end and supported by the freestanding frame, a lateral movement assembly in communication with the support, and a brake in communication with the support to adjust lateral movement when applied. Accordingly, it is an object of the present invention to provide a core exercise device that has controllable lateral movement while exercising.

According to another embodiment of the invention, the support is a substantially rigid elongate structure and the freestanding frame is in communication with the first end and/or the second end of the support wherein the freestanding frame is one or two separate components in communication with the first end and/or the second end of the support. Accordingly, it is another object of the present invention to provide an inclined rigid floor-standing exercise device for the user to lie on while performing core exercises.

According to yet another embodiment of the core exercise device, the freestanding frame is configured to provide a plurality of heights for one or both ends of the support. Furthermore, the freestanding frame may provide a plurality of substantially horizontal surfaces at differing heights for one or both ends of the support. Thus, it is an object of the invention to provide a mechanism for adjusting the slope of the incline by adjusting the height of one or both ends of the support thereby adjusting the difficulty of the exercise or the muscle groups targeted by the exercise.

According to still another embodiment of the invention, the lateral movement assembly allows a movement of one or more portions of the support, including substantially the entire support, wherein the movement is substantially in a plane perpendicular to a longitudinal axis of a user on the support. It is therefore another object of the invention to have lateral movement during the exercise that the user must counteract, thereby adjusting the difficulty of the exercise or the muscle groups targeted by the exercise.

In another embodiment of the invention, the lateral movement may be an up-and-down motion, a side-to-side motion, a swinging motion, a rotating motion with respect to the longitudinal axis of the support, or a random motion. It is thus an object of the core exercise device to provide a particular type of lateral movement that the user must counteract during the core exercises. Furthermore, the movement is induced or inhibited by either the user's movement during an exercise, an electric motor in communication with at least one portion of the support, or a third person having a control that is in communication with at least one portion of the support. Accordingly, it is another object of the invention to provide either a user-generated or an external source of movement to counteract.

According to still another embodiment of the invention, a portion or portions of the support are supporting substantially the entire body of the user, substantially the lower body of the user, substantially the upper body of the user, and substantially the midsection of the user. Thus, the object of the embodiment is to provide different body regions that are independently movable thereby targeting differing muscle groups and providing differing levels of difficulty.

In another embodiment of the present invention, the lateral movement assembly has at least one rocker element in communication with the support and an underlying surface (such as the floor or the freestanding frame) wherein the portion of the rocking element in communication with the underlying surface moves with respect to that surface. Accordingly, it is one object of the invention to provide creates lateral movement with a simple lateral rocking element.

According to still another embodiment of the present invention, the lateral movement assembly has one or more elements in communication with the support and the freestanding frame consisting of: a hanging element that hangs at least a portion of the support from the freestanding frame, a spring element that supports at least a portion of the support on the freestanding frame, a rotatable element that supports at least a portion of the support on the freestanding frame, and a compressible element that supports at least a portion of the support on the freestanding frame. Thus it is an object of the present invention to provide lateral movement between the freestanding frame and the support that can be easily implemented with a hanger, a spring, rotatable bearings, compressible cylinders, and the like.

According to yet another embodiment of the present invention, the core exercise device has a brake that has at least one handle that is accessible by a user and a brake element in communication with the freestanding support such that the brake can inhibit or substantially stop movement of the support thereby controlling a resistance of movement of the support to increase or decrease a difficulty level of a user's exercise, or allowing the user to safely mount and dismount the core exercise device.

According to another embodiment of the present invention, the core exercise device has a removable lower body support configured to go beneath a portion of a user's legs, and a holding device configured for receiving at least a portion of a user's lower extremities and holding the portion in a substantially fixed relationship to the support. Thus, it is an object of the present invention to provide and retain the proper positioning of the legs while doing core exercises such as sit-ups and crunches.

The core exercise device may further include a holding device configured for receiving at least a portion of a user's upper extremities and holding the portion in a substantially fixed relationship to the support. Thus, it is an object of the present invention to provide a handhold for the user to grasp while doing core exercises such as leg lifts.

According to another embodiment of the present invention the core exercise device has a support configured to receive a human during exercises that is substantially elongate and rigid having an opposing fore end and a aft end, a freestanding frame in communication with the support and an underlying floor (having substantially horizontal elements configured to support the aft end of the support at a plurality of heights), a lateral movement assembly in communication with the support having a aft end rocker element comprising a curved lower surface in communication with one of the freestanding support horizontal elements and a fore end rocker element comprising a curved lower surface in communication with the floor; and a brake in communication with the support to adjust lateral movement and having one or more hand controls for adjusting. Accordingly, it is an object of the present invention to provide a core exercise device that has controllable lateral movement while exercising.

According to another embodiment of the present invention there is a method of core exercising with steps of: adjusting a height of one or more ends of a support, mounting the support in a lying position with the feet proximal to one end of the support, disengaging and adjusting a brake to allow substantially lateral movement of at least one portion of the support, moving a lower extremity or the lower body (leg raises or leg lifts with one or both legs), the mid-section (glut raises), the upper body (sit-ups), or the head (crunches), engaging the brake to inhibit movement of the support; and dismounting the support. Therefore, it is a feature of at least one embodiment of the invention to provide a method of core exercising that has multiple core exercises with controllable lateral movement.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
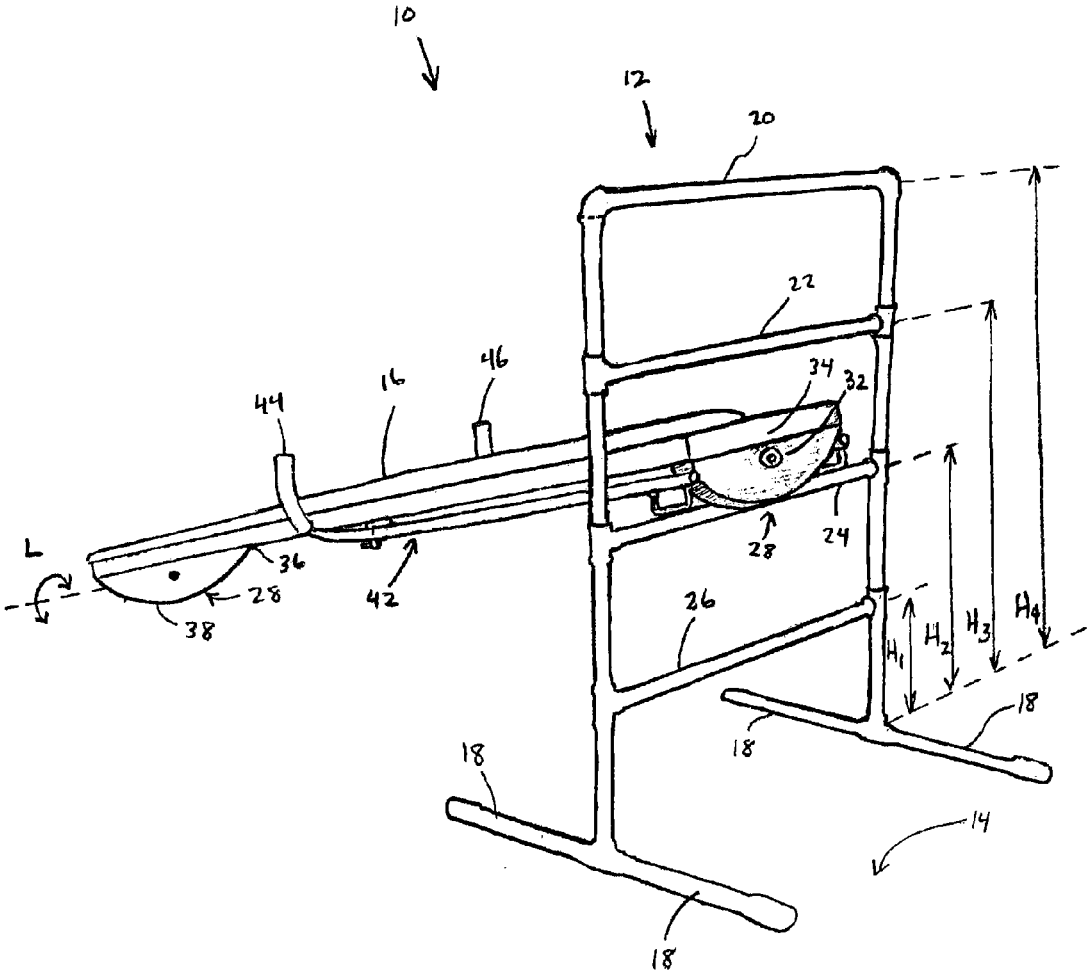
FIG. 1 illustrates a perspective view of the core exercise device of the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "communicates", or terms similar thereto are often used. They are not limited to direct communication but include communication through other elements where such communication is recognized as being equivalent by those skilled in the art.

Further, before any embodiments of the invention are explained in detail, it is to be understood that the invention is capable of other embodiments and of being practiced or of being carried out in various ways. Also, it is to be understood that the phraseology and terminology used herein is for the purpose of description and should not be regarded as limiting. The use of "including," "comprising," "at least one of," or "having" and variations thereof herein is meant to encompass the items listed thereafter and equivalents thereof as well as additional items.

DESCRIPTION OF PREFERRED EMBODIMENTS

The present invention and the various features and advantageous details thereof are explained more fully with reference to the non-limiting embodiments described in detail in the following description.

Note that the detailed description that follows the drawings, which are used, do not show all the details of every system described, but only certain features of the invention that aid in describing the invention. One skilled in the art will see the benefits of this new invention and know of all the other methods of construction and design.

1. SYSTEM OVERVIEW

The present invention relates to a core exercise device for a human user that allows lateral movements requiring the user to balance or otherwise adapt their equilibrium. Briefly, this is accomplished by a lateral movement system controlled by a brake. When the brake is disengaged the lateral movements are allowed to some degree. When the brake is engaged the exercise device is locked so that lateral movement is inhibited. This allows the user to mount and dismount the core exercise device while the lateral movement is locked-out. It also may allow the user to control the amount of lateral movement, or the amount of force or force per unit distance required for lateral movement.

2. DETAILED DESCRIPTION OF PREFERRED EMBODIMENTS

Various embodiments of the present invention are shown in FIGS. 1-7, which are described in additional detail below.

Referring now to FIG. 1 a preferred embodiment of the core exercise device 10 of the present invention comprises a freestanding frame 12 in communication with an underlying surface such as floor 14. The freestanding frame 12 holds a support 16 configured to receive a human user during core exercises. The support 16 may be a substantially rigid elongate structure as shown, or some other support capable of receiving a human during core exercises.

The freestanding frame 12 has feet 18 standing upon floor 14. The freestanding frame 12 is configured to provide a plurality of heights for one end of the support 16. In the embodiment of FIG. 1 the frame 12 holds the support 16 at one of a four heights (as measured from the floor 14) $H_1$, $H_2$, $H_3$, $H_4$ When the support is resting on rungs 26, 24, 22, respectively. In an alternate embodiment the freestanding frame 12 may provide for more heights, including a continuously adjustable height mechanism; or fewer heights including a single pre-configured height (not shown). In another alternative embodiment, the frame 12 may support both ends of the user support 16 at the same or differing heights (not shown).

Continuing with FIG. 1, in addition the preferred embodiment 10 may have a lateral movement assembly 28 that provides lateral movement such as rocking motion shown as arrow L about some axis A. The lateral movement assembly 28 may consist of rocker plates 30, 32 having an upper portion 34, 36 in fixed communication with the support 16, and a lower curved surface 38, 40 in communication with the floor 14 and frame 12 (shown on rung 24). The lower curved surface 40 may have a groove to allow it to move across the top of the ladder rung 24 without slipping from the rung. Various lower curved surface shapes are possible such as a portion of a circle, or a portion of an ellipse, or any of a number of curved shapes wherein the rate and placement of curvature is adjusted to affect the stability of the support 16 and path of lateral movement L when the brake 42 is disengaged.

Another alternative embodiment may have a single rocker element, for example in communication with the floor 14, while the frame 16 may be rotatably or fluidly coupled to the support 16. In yet another embodiment the lateral movement assembly may comprise one or more springs or pneumatic cylinders coupling the support 16 to the floor 14, either directly or indirectly through an intervening frame. Yet another embodiment may have a lateral movement system wherein the curved surface of one or more rocker plates is in communication with the support 12 rather than the frame 16 or the floor 14. In yet another embodiment the lateral movement system may comprise supporting at least one end of the support 16 with an element that allows the support to hang from the freestanding frame 12.

Still referring to FIG. 1, the embodiment 10 also has a brake 42 having user accessible handles 44, 46 used for engaging, disengaging, and otherwise adjusting the brake 42 so as to inhibit, allow, or control that lateral movement L as will be explained below. Another embodiment may have safety rails on the longitudinal sides of the support, or a safety belt or harness to safely secure the user to the support (not shown).

Figure 2A:
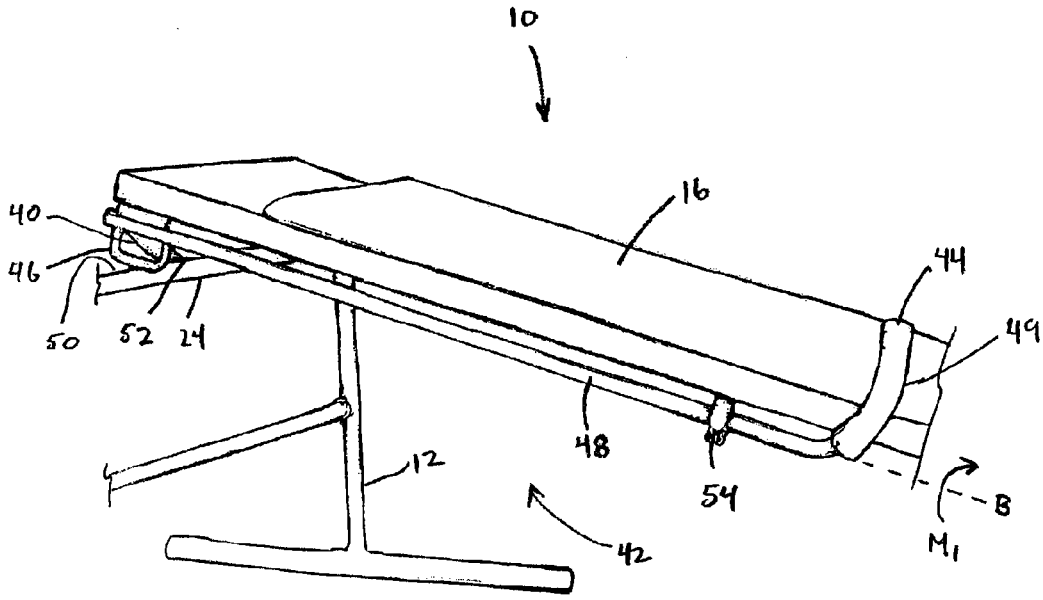
FIG. 2*a* is a perspective view of a portion of the core exercise device of the present invention showing the brake in the engaged position.
Figure 2B:
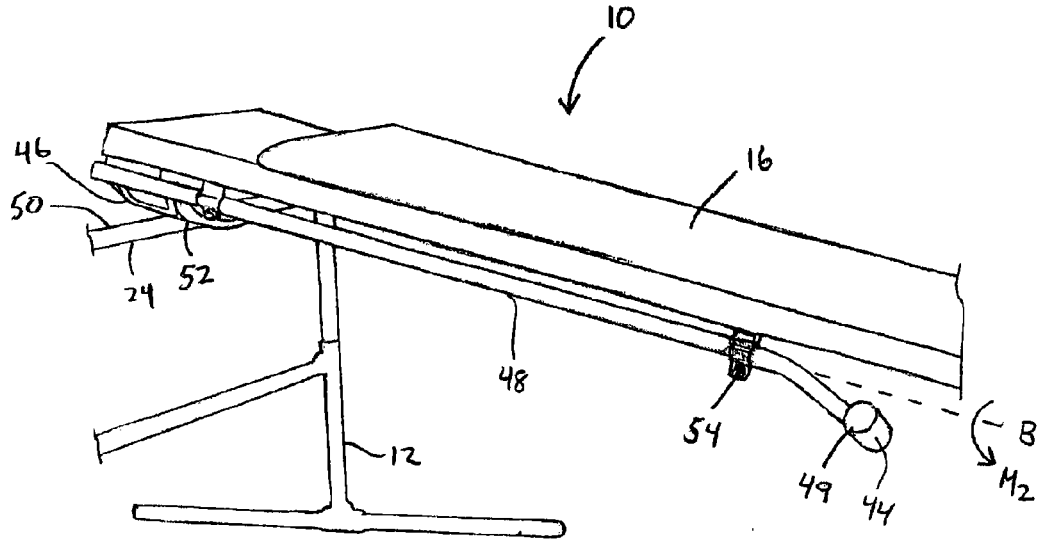
FIG. 2*b* is a perspective view of a portion of the core exercise device of the present invention showing the brake in the disengaged position.

Now referring to FIGS. 2*a* and 2*b*, the brake 42 of preferred embodiment 10 is described. The brake 42 may have one or more user-accessible handles 44 which are in mechanical communication with a braking element 46, for example, via rod 48, and may be padded or otherwise clad with a compressible material 49 for comfortable and slip-resistant grasping with a hand. Handle 44 may extend from the axis B of rod 48 to allow a rotational movement $M_1$ of handle 44 to engage the brake thereby preventing lateral movement of support 16 as shown in FIG. 2*a*. Similarly, rotational movement $M_2$ of handle 44 may disengage the brake thereby enabling lateral movement of support 16 as shown in FIG. 2*b*.

Now referring to FIG. 2*a*, the brake 42 is shown in the engaged position after movement $M_1$ has been applied. The braking element 46 is blocking movement of support 12 by immobilizing movement along the curved surface 40. This is accomplished by fixedly coupling upper surface 50 of rung 24 fixedly to the support 12 with the rigid body of braking element 46. Notably, the brake 42 is rotationally coupled to the support 12 such that translational movement is not allowed with respect to the support 12, but the brake handle 44 may be used to rotate the braking element 46.

Now referring to FIG. 2*b*, the brake 42 is shown in the disengaged position after movement $M_2$ has been applied. The braking element 46 is positioned so that the curved surface 40 may move along the upper surface 50 of rung 24 to allow for lateral rocking movement because braking element 46 is not coupling the support 12 to the upper surface 50.

Figure 3:
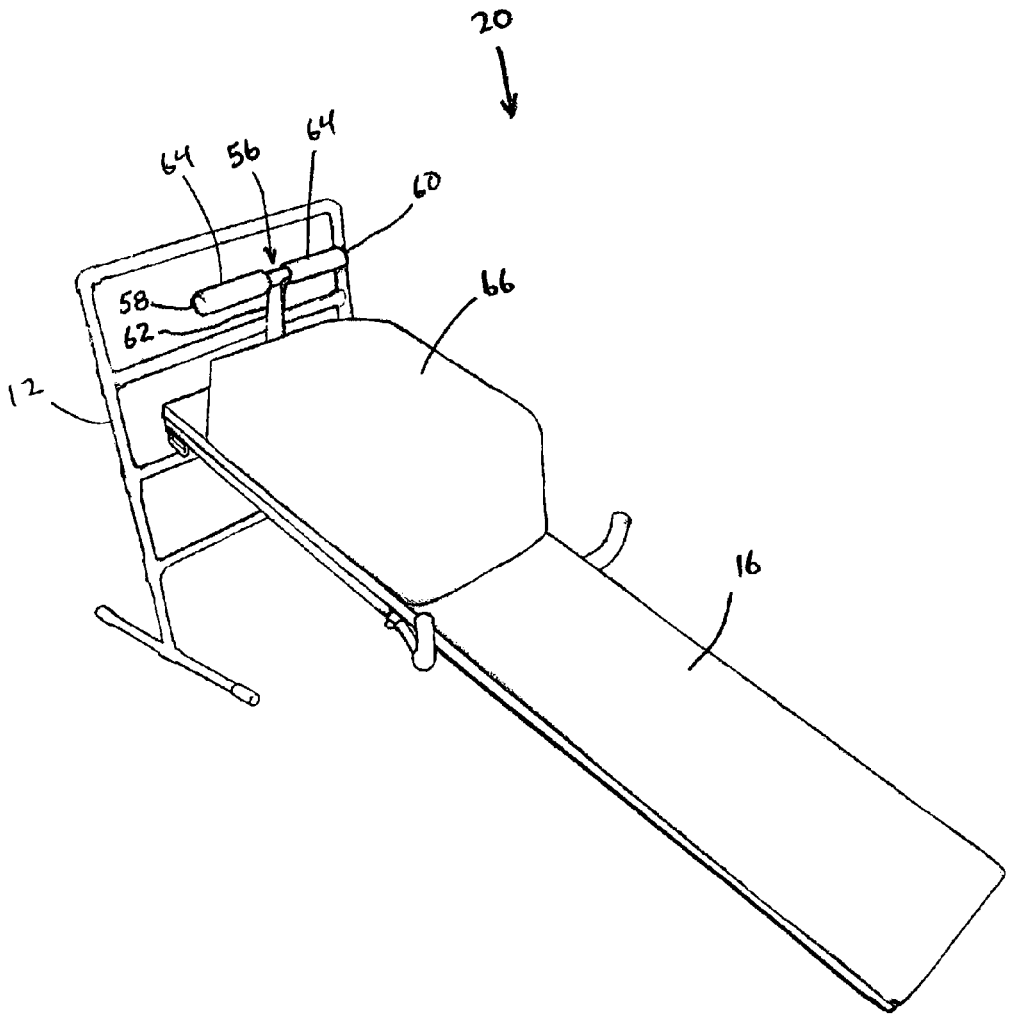
FIG. 3 is a perspective view of the core exercise device of the present invention showing the extremities support and pad.

Turning now to FIG. 3, another embodiment of the core exercise device 20 is described having an extremity holder 56 that may be used to support the user's legs or to grasp while exercising. The extremity holder 56 may have a largely horizontal portion with opposing ends 58, 60 connected to vertical portion 62, which is in turn connected to support 12. The ends of the support 58, 60 are largely horizontal and may be padded or otherwise clad with a compressible material for comfortable and slip-resistant grasping or engagement with the extremities. In addition, the core exercise device 20 may have a removable or permanently affixed pad 66 to provide support for a user's legs and may also act as a shim to allow the user's legs to be firmly coupled under the extremity holder ends 58, 60.

Figure 4:
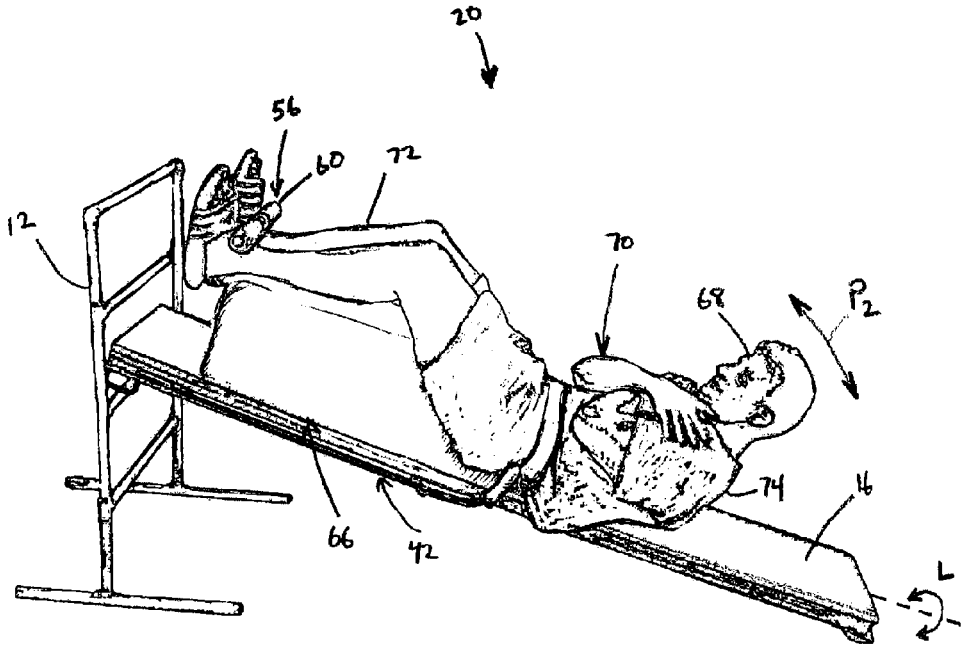
FIG. 4 is a perspective view of the core exercise device of the present invention with a user performing sit-ups.

Turning now to FIG. 4, an embodiment of the core exercise device 20 is shown with a user 70 with their head 68 distal of freestanding frame 12 performing a sit-up exercise. The user 70 lies prone on support 16 while his legs 72 are placed under the opposing ends 58, 60 of extremity holder 56 while lying on top of pad 66, thereby releasably securing and supporting the user's lower extremities 72. The user raises and lowers head 68 and torso 74 substantially along path $P_2$, the brake 42 may be disengaged so that user 70 works to maintain balance (i.e. nullify lateral movement L) during the sit-ups thereby performing balancing movements while doing sit-ups. The user 70 may pause in the movement pathway $P_2$ so that the head 68 or upper body 74 is substantially stationary (so-called isometrics) requiring the user 70 balance against the lateral movement about axis L in a fixed position. Alternatively, the user 70 may perform the sit-ups without a pad 66 or an extremity holder 56.

Figure 5:
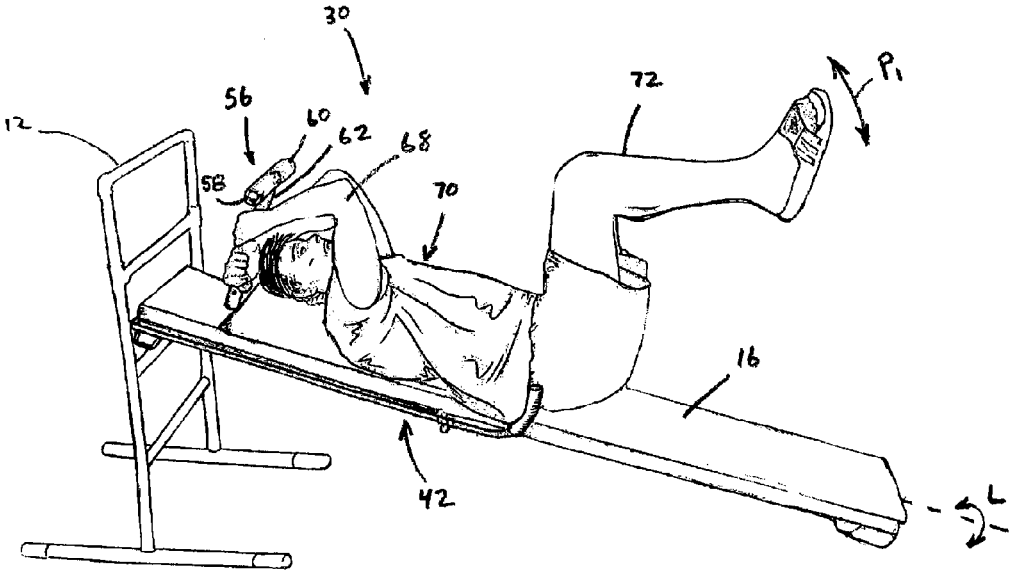
FIG. 5 is a perspective view of the core exercise device of the present invention with a user performing leg lifts.

Referring now to FIG. 5, an embodiment of the core exercise device 30 is shown with a user 70 with his head 68 proximate of the freestanding frame 12 performing a leg-lift exercise. The user 70 lies prone on support 16 while grasping the extremity holder 56 by its vertical component 62. The user raises and lowers legs 72 substantially along path $P_1$, the brake 42 may be disengaged so that user 70 works to maintain balance (i.e. nullify lateral movement L) during the leg lifts thereby performing balancing movements while doing leg-lifts. The user 70 may pause in the movement pathway $P_1$ so that the lower body 72 is substantially stationary (so-called isometrics) requiring the user 70 balance against the lateral movement about axis L in a fixed position. Alternatively, the user 70 may grasp the opposing ends 58, 60 of extremity holder 56 rather than the vertical portion 62.

In yet another embodiment the extremity holder 56 may be adjustable such that the ends 58, 60 may be raised or lowered to provide different grasping positions, or to allow different size users' legs to fit securably and comfortably between extremity holder 56 and pad 66.

Figure 6:
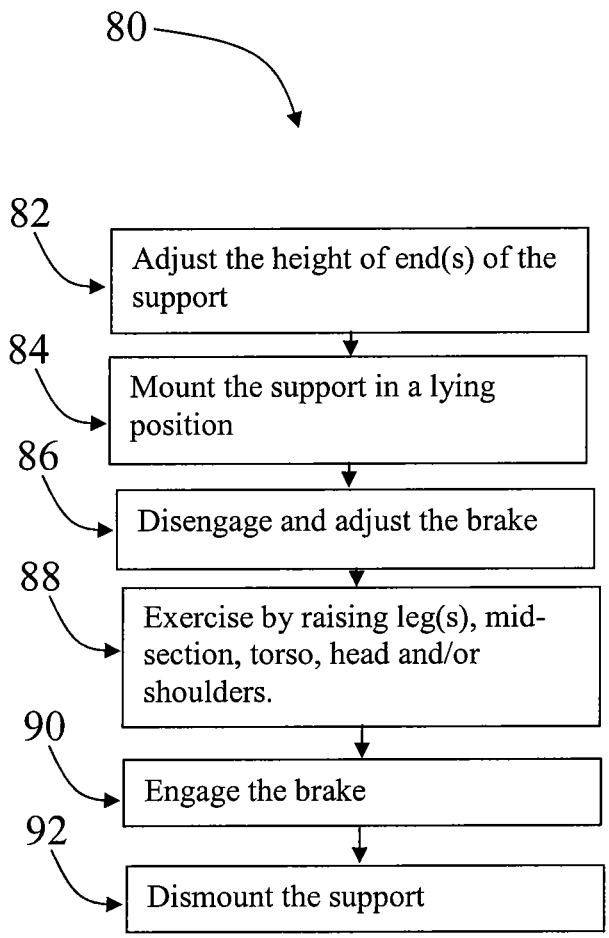
FIG. 6 is a flow chart of a method of exercising using the core exercise device of the present invention.

Turning now to FIG. 6, a method 80 of using the core exercise device is described. The user first adjusts a height of the end of the support at process block 82. The user then mounts the support in a lying position with the legs proximal to one end of the support at process block 84. The user disengages and adjusts the brake to allow lateral movement of the support at process block 86. The user then exercises by raising one or both legs in a leg lift, raising the mid-section in a gluteal lift, raising the torso in a sit-up, or just a portion of the upper body such as the head in a crunch at process block 88. The user then engages the brake to inhibit movement of the support at process block 90. Finally, the user dismounts the core exercise device at process block 92.

Figure 7:
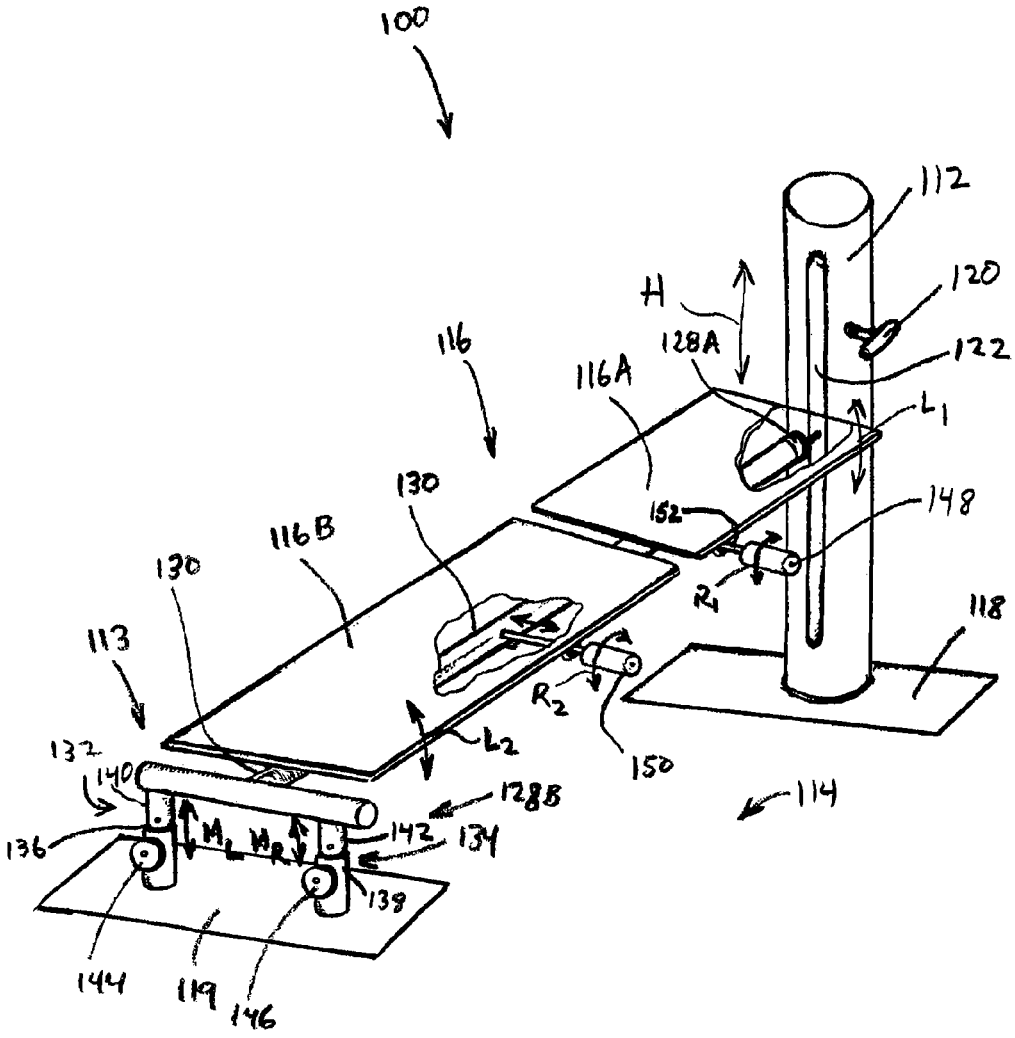
FIG. 7 illustrates a perspective view of another embodiment of the core exercise device of the present invention.

Referring now to FIG. 7 a preferred embodiment of the core exercise device 100 of the present invention comprises a freestanding frame 112 in communication with an underlying surface such as floor 114. The first freestanding frame 112 holds a support 116 configured to receive a human user during core exercises. The support 116 may be a substantially rigid elongate structure bifurcated into two independently movable sections 116A, 116B (shown in phantom). Alternatively, the support 116 may be a single movable section as shown in FIG. 1, or more than two movable sections (not shown). A second freestanding frame 113 may support the opposing end of support 116 proximal of support section 116B. The second freestanding frame 113 has a foot 119 standing upon floor 114 and the first freestanding frame 112 has a foot 118 standing upon floor 114. The freestanding frame 112 is configured to provide a plurality of heights for one end of the support 116 by providing a continuously adjustable height mechanism 122 along a substantially vertical path H shown as a slot 122 receiving an element in communication with support 116 and having a control element 120 for locking and unlocking the vertical movement path H.

Continuing with FIG. 7, in addition the embodiment 100 may have a lateral movement assemblies 128A and 128B that provides lateral movement such as limited rotational movement about central axis 130 shown as arrow $L_1$ for support 116A and $L_2$ for support 116B. The lateral movement assembly 128A may consist of springs, magnets, hydraulic chambers, or other elements that resist or allow the clockwise or counterclockwise movement of support 116A about axis 130. In addition, there may be stops that limit the movement of support 116A on one or both sides of axis 113 in either a clockwise or counterclockwise direction (not shown). The lateral movement assembly 128B that allows movement of support 116B may consist of movable cylinder assemblies 132, 134 placed at opposite horizontally displaced and substantially equidistant positions from axis 130. Movable cylinder assemblies 132, 134 may consist of an internal cylinder 140, 142 that can move substantially vertically in relationship to fixed outer cylinder 136, 138 shown as arrows $M_L$ and $M_R$ respectively. The inner cylinders 140, 142 are in a fixed relationship with support 116B such that movements $M_L$ and $M_R$ cause a corresponding rotating movement $L_2$ of support 116B. The inner cylinder 140, 142 may have a resistive element (not shown) that resists downward or upward movement of the inner cylinder 140, 142 with respect to outer cylinder 136, 138 such as a trapped fluid such as air, a spring, repulsive magnet pairs, attractive magnet pairs or the like. In addition, there may be a downward or upward stop (not shown) that limits the vertical range of motion of the inner cylinder 140, 142 with respect to the outer cylinder 136, 138. Finally, each cylinder assembly 132, 134 may have a control such as knob 144, 146 that may allow the resistance to be decreased or increased by moving the knob 144, 146 to another position.

Finishing with FIG. 7, the embodiment 100 may also have brake 148, 150 for inhibiting or adjusting the lateral movement of support 116A and 116B respectively. Brake handle 148, 150 may be tightened or loosened by rotating clockwise or counterclockwise as shown by arrows $R_1$ and $R_2$ respectively. For example, rotating brake 148 clockwise may move brake element 152 against axis 130 providing a frictional coupling which impedes the movement of support 116A with respect to axis 130. Alternative embodiments of the brake may include other types of frictional couplings, or mechanically locking members, or may comprise a range of adjustments or tensions.

Various alternatives and modifications are contemplated as being within the scope of the following claims particularly pointing out and distinctly claiming the subject matter regarded as the invention. For example, it should be understood that the actual dimensions of the device's components are not essential to the invention, but certain dimensions are provided for illustrative purposes. Many changes and modifications could be made to the invention without departing from the spirit thereof. The scope of these changes will become apparent from the appended claims.

What is claimed is:

1. A core exercise device, comprising:

a freestanding frame;

a support configured to receive a human during exercises having a first end, a second end, a first side and a second side, and supported by the freestanding frame;

a lateral rocking movement assembly in communication with the support, comprising at least one rocker element extending from an underlying surface of the support at the first or second end, the at least one rocker element having a curved lower surface that extends substantially from the first side of the support to the second side of the support; and a brake configured to selectively adjust lateral rocking movement of the support over a range of selectable lateral rocking movement when applied;

wherein the support is configured to be stabilized when the human performs an exercise movement thereon, the exercise movement selected from one or more of a group consisting of: moving a lower body, moving a mid-section, moving an upper body, and moving a head of the human.

2. The core exercise device of claim 1 wherein the support comprises a substantially rigid elongate structure.

3. The core exercise device of claim 1 wherein the free-standing frame is in communication with the first end or the second end of the support.

4. The core exercise device of claim 1 wherein the free-standing frame is configured to provide a plurality of heights for one or both ends of the support.

5. The core exercise device of claim 4 wherein the free-standing frame provides a plurality of substantially horizontal surfaces at differing heights for one or both ends of the support.

6. The core exercise device of claim 1 wherein the lateral rocking movement assembly allows a movement of one or more portions of the support, including substantially the entire support, wherein the movement is substantially in a plane perpendicular to a longitudinal axis of a user on the support.

7. The core exercise device of claim 6 wherein the movement substantially comprises one or more selected from a group consisting of: an up-and-down motion, a side-to-side motion, a swinging motion, a rotating motion with respect to the longitudinal axis of the support, and a random motion.

8. The core exercise device of claim 6 wherein the movement is induced or inhibited by one or more selected from a group consisting of: the user's movement during an exercise, and a third person having a control that is in communication with at least one portion of the support.

9. The core exercise device of claim 6 wherein the portion or portions of the support are supporting one or more selected from a group consisting of substantially the entire body of the user, substantially the lower body of the user, substantially the upper body of the user, and substantially the midsection of the user.

10. The core exercise device of claim 6 wherein the at least one rocker element is in communication an underlying surface wherein the portion of the rocking element in communication with the underlying surface moves with respect to that surface.

11. The lateral rocking movement assembly of claim 10 wherein the underlying surface is one or both of a floor and a freestanding frame.

12. The core exercise device of claim 1 wherein the brake further comprises at least one handle that is accessible by a user and a brake element in communication with the free-standing support such that the brake can inhibit or substantially stop movement of the support thereby controlling a resistance of movement of the support to increase or decrease a difficulty level of a user's exercise, or allowing the user to safely mount and dismount the core exercise device.

13. The core exercise device of claim 1 wherein the brake further comprises a stationary brake element that is selectively engaged by human.

14. The core exercise device of claim 1 further comprising a holding device configured for receiving at least a portion of a user's lower extremities and holding the portion in a substantially fixed relationship to the support.

15. The core exercise device of claim 1 further comprising a holding device configured for receiving at least a portion of a user's upper extremities and holding the portion in a substantially fixed relationship to the support.

16. A core exercise device comprising:

a support configured to receive a human during exercises that is substantially elongate and rigid having an opposing fore end and a aft end and an opposing first side and a second side;

a freestanding frame in communication with the support and an underlying floor, and having a plurality of substantially horizontal surfaces at differing heights configured to support the aft end of the support at a plurality of heights;

a lateral rocking movement assembly in communication with the support having an aft end rocker element comprising a curved lower surface extending substantially from the first side to the opposing second side of the support, in communication with one of the plurality of substantially horizontal surfaces and a fore end rocker element comprising a curved lower surface extending substantially from the first side to the second side of the support, in communication with the underlying floor; and a brake configured to selectively reduce lateral rocking movement of the support over a range of selectable lateral rocking movement.

17. A method of core exercising comprising steps of providing a support having a first end, a second end, a first side and an opposing second side, and at least one rocker element extending from an underlying surface of the support, the at least one rocker element having a curved lower surface that extends substantially from the first side of the support to the opposing second side of the support;

adjusting a height of the first end of the support or the second end of the support;

a user mounting the support in a lying position with the feet of the user proximal to one end of the support;

releasing a brake to selectively increase lateral rocking movement of at least one portion of the support over a range of selectable lateral rocking movement;

moving one or more portions of the user's body selected from a group consisting of: at least one lower extremity, a lower body, a mid-section, an upper body, and a head wherein the feet are proximal to the end of the support or the opposite end of the support applying the brake to selectively reduce lateral rocking movement of the support over a range of selectable lateral rocking movement; and dismounting the support.

* * * * *